US010827845B2

(12) United States Patent
Ghanei et al.

(10) Patent No.: US 10,827,845 B2
(45) Date of Patent: Nov. 10, 2020

(54) SUPPORT CUSHIONS INCLUDING A SUPPORT INSERT WITH A BAG FOR DIRECTING AIR FLOW, AND METHODS FOR CONTROLLING SURFACE TEMPERATURE OF SAME

(71) Applicant: Sealy Technology, LLC, Trinity, NC (US)

(72) Inventors: Hamid Ghanei, Trinity, NC (US); Abdelkrim Bedja, Trinity, NC (US); Taylor M. Jansen, Trinity, NC (US); James Alva Evans, Jr., Trinity, NC (US)

(73) Assignee: Sealy Technology, LLC, Trinity, NC (US)

( * ) Notice: Subject to any disclaimer, the term of this patent is extended or adjusted under 35 U.S.C. 154(b) by 196 days.

(21) Appl. No.: 15/902,615

(22) Filed: Feb. 22, 2018

(65) Prior Publication Data

US 2018/0242753 A1 Aug. 30, 2018

Related U.S. Application Data

(60) Provisional application No. 62/463,062, filed on Feb. 24, 2017.

(51) Int. Cl.

| | |
|---|---|
| ***A47C 21/04*** | (2006.01) |
| ***A47C 27/05*** | (2006.01) |
| ***A47C 27/22*** | (2006.01) |

(52) U.S. Cl.

CPC ..... *A47C 21/044* (2013.01); *A47C 21/048* (2013.01); *A47C 27/056* (2013.01); *A47C 27/22* (2013.01)

(58) Field of Classification Search

CPC ..... A47C 21/044; A47C 21/048; A47C 21/00; A47C 21/04; A47C 21/042; A27C 27/22; A27C 27/056

See application file for complete search history.

(56) References Cited

U.S. PATENT DOCUMENTS 1,142,876 A 6/1915 Davis et al.
2,462,984 A * 3/1949 Maddison ..... A47C 21/044 5/423

(Continued)

FOREIGN PATENT DOCUMENTS

CA 2428225 A1 5/2002
EP 1997467 12/2008

(Continued)

OTHER PUBLICATIONS

PCT/US2009/068814 International Search Report.

(Continued)

*Primary Examiner* — Robert G Santos
*Assistant Examiner* — Alison N Labarge
(74) *Attorney, Agent, or Firm* — Middleton Reutlinger

(57) ABSTRACT

A support cushion for providing individualized heating and cooling to a user resting on the support cushion is provided. The support cushion includes a body supporting layer and a base layer positioned adjacent to and below the body supporting layer. The base layer defines a cavity with a support insert positioned within the cavity. The support insert includes a bag defining one or more outlet holes positioned adjacent to the body supporting layer and further defining an inlet hole. A fan is operably connected to the inlet hole of the bag to provide air flow into the inlet hole of the bag and out of the one or more outlet holes of the bag. Methods of controlling the surface temperature of a support cushion are also provided.

20 Claims, 4 Drawing Sheets

(56) References Cited

U.S. PATENT DOCUMENTS 3,101,488 A 8/1963 Peebles
3,266,064 A 8/1966 Figman
3,529,310 A 9/1970 Olmo
4,467,611 A 8/1984 Nelson et al.
4,580,301 A 4/1986 Ludman et al.
4,644,753 A 2/1987 Burke
4,922,721 A 5/1990 Robertson et al.
5,136,850 A 8/1992 Bierschenk et al.
5,171,272 A 12/1992 Recine, Sr.
5,249,826 A 10/1993 Bell
5,295,709 A 3/1994 Bell
5,315,830 A 5/1994 Doke et al.
5,367,879 A 11/1994 Doke et al.
5,367,890 A 11/1994 Doke
5,398,510 A 3/1995 Gilley et al.
5,448,788 A 9/1995 Wu
5,487,002 A 1/1996 Diller et al.
5,501,076 A 3/1996 Sharp, III et al.
5,505,046 A 4/1996 Nelson et al.
5,518,271 A 5/1996 Bell
5,522,216 A 6/1996 Park et al.
5,524,439 A 6/1996 Gallup et al.
5,546,618 A 8/1996 Beedy et al.
5,576,512 A 11/1996 Doke
5,597,200 A 1/1997 Gregory et al.
5,626,021 A 5/1997 Karunasiri et al.
5,650,904 A 7/1997 Gilley et al.
5,703,464 A 12/1997 Karunasiri et al.
5,737,923 A 4/1998 Gilley et al.
5,860,280 A 1/1999 Recine, Sr. et al.
5,887,304 A * 3/1999 von der Heyde .... A47C 21/044 5/423
6,003,319 A 12/1999 Gilley et al.
6,069,581 A 5/2000 Bell et al.
6,119,463 A 9/2000 Bell
6,169,245 B1 1/2001 Sharp
6,188,011 B1 2/2001 Nolas et al.
6,207,888 B1 3/2001 Nolas
6,223,539 B1 5/2001 Bell
6,232,910 B1 5/2001 Bell et al.
6,253,401 B1 7/2001 Boyd
6,269,314 B1 7/2001 Iitawaki et al.
6,336,237 B1 1/2002 Schmid
6,358,608 B1 3/2002 Hanyon et al.
6,360,390 B1 3/2002 Bonaddio
6,372,812 B1 4/2002 Niederoest et al.
6,380,883 B1 4/2002 Bell et al.
6,399,871 B1 6/2002 Sharp
6,400,308 B1 6/2002 Bell et al.
6,425,527 B1 7/2002 Smole
6,492,585 B1 12/2002 Zamboni et al.
6,546,576 B1 4/2003 Lin
RE38,138 E 6/2003 Gallup et al.
6,606,866 B2 8/2003 Bell
6,660,925 B1 12/2003 Sharp
6,700,052 B2 3/2004 Be
6,716,890 B1 4/2004 Niederoest et al.
6,734,220 B2 5/2004 Niederoest et al.
6,740,687 B2 5/2004 Niederoest et al.
6,756,416 B2 6/2004 Free et al.
6,823,548 B2 11/2004 Murphy et al.
6,841,586 B2 1/2005 Free et al.
7,005,458 B2 2/2006 Lovette
7,114,771 B2 10/2006 Lofy et al.
7,150,059 B2 12/2006 Small, Jr. et al.
7,165,281 B2 1/2007 Larsson et al.
7,178,344 B2 2/2007 Bell
7,240,386 B1 7/2007 McKay et al.
7,475,464 B2 1/2009 Lofy et al.
7,484,256 B2 2/2009 Murphy et al.
7,531,739 B1 5/2009 Moczygemba
7,587,901 B2 9/2009 Petrovski
7,589,037 B2 9/2009 Handermann et al.
7,591,507 B2 9/2009 Giffin et al.
7,619,158 B2 11/2009 Sharp et al.
7,640,754 B2 1/2010 Wolas
7,665,803 B2 2/2010 Wolas
7,687,139 B2 3/2010 Chan et al.
7,708,338 B2 5/2010 Wolas
7,763,792 B2 7/2010 Sharp et al.
RE41,765 E 9/2010 Gregory et al.
7,827,805 B2 11/2010 Comiskey et al.
7,849,542 B2 12/2010 DeFranks
7,858,542 B2 12/2010 Mio et al.
7,871,847 B2 1/2011 Moczygemba
7,877,827 B2 2/2011 Gentherm
7,886,388 B2 2/2011 Warren et al.
7,908,687 B2 3/2011 Ward et al.
7,913,332 B1 3/2011 Barnhart
D636,622 S 4/2011 Quinter et al.
7,963,594 B2 6/2011 Wolas
7,966,835 B2 6/2011 Petrovski
D642,413 S 8/2011 Rinehart
D642,845 S 8/2011 Farley
D642,847 S 8/2011 Rinehart
7,996,936 B2 8/2011 Gentherm
8,065,763 B2 * 11/2011 Brykalski ..... A47C 21/048 5/423
D652,715 S 1/2012 Quinter et al.
8,104,295 B2 1/2012 Lofy
8,143,554 B2 3/2012 Lofy
8,181,290 B2 5/2012 Brykalski et al.
8,191,187 B2 6/2012 Brykalski et al.
8,209,804 B2 7/2012 Apperson et al.
8,222,511 B2 7/2012 Lofy
8,247,466 B2 8/2012 Brown
D667,671 S 9/2012 Rinehart
8,256,236 B2 9/2012 Lofy
8,332,975 B2 * 12/2012 Brykalski ..... A47C 21/044 5/421
8,353,069 B1 1/2013 Miller
8,359,689 B2 1/2013 Warren et al.
8,359,871 B2 1/2013 Woods et al.
8,402,579 B2 3/2013 Marquette et al.
8,418,286 B2 4/2013 Bryklaski et al.
8,434,314 B2 5/2013 Comiskey et al.
8,438,863 B2 5/2013 Lofy
RE44,272 E 6/2013 Bell
8,621,694 B2 1/2014 Farley
8,703,631 B2 4/2014 Sytz
8,732,874 B2 5/2014 Gentherm
8,745,784 B2 6/2014 Cole et al.
8,782,830 B2 7/2014 Gentherm
8,856,993 B2 10/2014 Richards et al.
8,893,329 B2 11/2014 Petrovski et al.
8,955,337 B2 2/2015 Parish et al.
9,044,365 B2 6/2015 Ascion
9,044,366 B2 6/2015 Ascion
9,066,497 B2 6/2015 Ascion
D733,452 S 7/2015 Ascion
D736,023 S 8/2015 Ascion
9,125,497 B2 9/2015 Brykalski et al.
9,138,064 B2 9/2015 Tursi, Jr. et al.
9,173,793 B2 11/2015 Ascion
9,173,794 B2 11/2015 Ascion
9,211,017 B2 * 12/2015 Tyree ..... A47C 21/042
9,265,352 B2 2/2016 Oakhill et al.
9,289,072 B2 3/2016 Albero et al.
9,307,843 B2 4/2016 Ascion
D756,678 S 5/2016 Ascion
D757,527 S 5/2016 Ascion
9,392,875 B2 7/2016 Weyl
D763,005 S 8/2016 Ascion
9,433,546 B2 9/2016 Ascion
9,451,833 B2 9/2016 Ascion
9,463,124 B2 10/2016 Lachenbruch et al.
9,474,384 B2 10/2016 Ascion
9,504,333 B2 11/2016 Ascion
9,510,690 B2 12/2016 Ascion
9,526,346 B2 12/2016 Ascion
9,526,348 B2 12/2016 Richards et al.
9,526,665 B2 12/2016 Ascion
D778,639 S 2/2017 Ascion
9,578,975 B2 2/2017 Rawls-Meehan et al.

(56) References Cited

U.S. PATENT DOCUMENTS

| | | | | |
|---|---|---|---|---|
| 9,596,945 | B2 | 3/2017 | Ghanei et al. | |
| 9,603,459 | B2 | 3/2017 | Gentherm | |
| 9,622,588 | B2 | 4/2017 | Brykalski et al. | |
| 9,629,473 | B2 | 4/2017 | Ascion | |
| D785,360 | S | 5/2017 | Ascion | |
| 9,655,797 | B2 | 5/2017 | Ascion | |
| D793,786 | S | 8/2017 | Ascion | |
| D793,789 | S | 8/2017 | Ascion | |
| 9,730,847 | B2 | 8/2017 | Lachenbruch et al. | |
| 9,955,791 | B2 | 5/2018 | Chandler et al. | |
| 2003/0019044 | A1 | 1/2003 | Larsson et al. | |
| 2004/0031103 | A1 | 2/2004 | Wyatt et al. | |
| 2004/0079407 | A1 | 4/2004 | Sharp | |
| 2004/0261830 | A1 | 12/2004 | Sharp et al. | |
| 2006/0107989 | A1 | 5/2006 | Bierschenk et al. | |
| 2006/0124165 | A1 | 6/2006 | Bierschenk et al. | |
| 2006/0180192 | A1 | 8/2006 | Sharp et al. | |
| 2007/0056116 | A1 | 3/2007 | Galardo | |
| 2007/0136952 | A1* | 6/2007 | Sargent | A47C 21/044 5/726 |
| 2007/0261548 | A1 | 11/2007 | Vrzalik et al. | |
| 2008/0028536 | A1 | 2/2008 | Hadden-Cook | |
| 2008/0047598 | A1 | 2/2008 | Lofy | |
| 2008/0084095 | A1 | 4/2008 | Wolas | |
| 2008/0100101 | A1 | 5/2008 | Wolas | |
| 2008/0148481 | A1 | 6/2008 | Brykalski et al. | |
| 2008/0173022 | A1 | 7/2008 | Petrovski | |
| 2008/0245397 | A1 | 10/2008 | Moczygemba et al. | |
| 2008/0263775 | A1 | 10/2008 | Clenet | |
| 2009/0064411 | A1 | 3/2009 | Marquette et al. | |
| 2009/0090409 | A1 | 4/2009 | Moczygemba | |
| 2009/0090544 | A1 | 4/2009 | Rawot et al. | |
| 2009/0093078 | A1 | 4/2009 | Moczygemba | |
| 2009/0193814 | A1 | 8/2009 | Lofy | |
| 2009/0211619 | A1 | 8/2009 | Sharp et al. | |
| 2009/0218855 | A1 | 9/2009 | Wolas | |
| 2010/0011502 | A1* | 1/2010 | Brykalski | A47C 21/044 5/423 |
| 2010/0081191 | A1 | 4/2010 | Woods | |
| 2010/0146700 | A1 | 6/2010 | Wolas | |
| 2010/0019968 | A1 | 8/2010 | Woods et al. | |
| 2010/0193498 | A1 | 8/2010 | Walsh | |
| 2011/0035880 | A1 | 2/2011 | Cole et al. | |
| 2011/0048033 | A1 | 3/2011 | Comiskey et al. | |
| 2011/0107514 | A1 | 5/2011 | Brykalski et al. | |
| 2011/0119826 | A1 | 5/2011 | Marquette et al. | |
| 2011/0253340 | A1 | 10/2011 | Petrovski | |
| 2011/0258778 | A1 | 10/2011 | Brykalski et al. | |
| 2011/0271994 | A1 | 11/2011 | Gilley | |
| 2011/0289684 | A1 | 12/2011 | Parish et al. | |
| 2011/0296611 | A1 | 12/2011 | Marquette et al. | |
| 2011/0308020 | A1 | 12/2011 | Vrzalik et al. | |
| 2011/0314837 | A1 | 12/2011 | Parish et al. | |
| 2012/0000207 | A1 | 1/2012 | Parish et al. | |
| 2012/0080911 | A1 | 4/2012 | Brykalski et al. | |
| 2012/0114512 | A1 | 5/2012 | Lofy et al. | |
| 2012/0131748 | A1 | 5/2012 | Brykalski et al. | |
| 2012/0227182 | A1 | 9/2012 | Brykalski et al. | |
| 2012/0261399 | A1 | 10/2012 | Lofy | |
| 2012/0305043 | A1 | 12/2012 | Kossakovski et al. | |
| 2012/0319439 | A1 | 12/2012 | Lofy | |
| 2013/0032189 | A1 | 2/2013 | Moczygemba et al. | |
| 2013/0037073 | A1 | 2/2013 | LaGrandeur et al. | |
| 2013/0059190 | A1 | 3/2013 | Kossakovski et al. | |
| 2013/0067661 | A1 | 3/2013 | Schwirian et al. | |
| 2013/0086923 | A1 | 4/2013 | Petrovski et al. | |
| 2013/0097777 | A1 | 4/2013 | Marquette et al. | |
| 2013/0146116 | A1 | 6/2013 | Jovovic et al. | |
| 2013/0186448 | A1 | 7/2013 | Ranalli et al. | |
| 2014/0059780 | A1 | 3/2014 | Lafleche et al. | |
| 2014/0189951 | A1* | 7/2014 | DeFranks | A47C 27/064 5/423 |
| 2014/0250604 | A1 | 9/2014 | Lanning et al. | |
| 2014/0310881 | A1 | 10/2014 | Wyatt et al. | |
| 2015/0296992 | A1* | 10/2015 | Ghanei | A47C 21/044 5/423 |
| 2017/0020300 | A1 | 1/2017 | Murphy et al. | |
| 2018/0110341 | A1* | 4/2018 | Reynolds | A47C 21/044 |

FOREIGN PATENT DOCUMENTS

| | | |
|---|---|---|
| JP | 55-34463 | 8/1953 |
| JP | 6022829 | 2/1994 |
| JP | 07-313306 | 12/1995 |
| JP | 2003-024184 | 1/2003 |
| JP | 2006-014819 | 1/2006 |
| MX | 2007002587 A | 5/2007 |
| WO | 2005120295 | 12/2005 |
| WO | 2009155595 A3 | 12/2009 |
| WO | 2014105039 A1 | 7/2014 |
| WO | 2015034528 A1 | 3/2015 |
| WO | 2015199667 A1 | 12/2015 |
| WO | 2016178057 A1 | 11/2016 |

OTHER PUBLICATIONS

Amerigon Incorporated, "Amerigon Reports 2008 Third Quarter, Nine-Month Results," press release, Oct. 28, 2008, pp. 4-10, PR Newswire, Yahoo Inc.

PCT/US2014/043993 International Search Report, 3 pgs.

PCT/US2013/058681 International Preliminary Report on Patentability; 10 pgs.

PCT/US2015/026086 Written Opinion and International Preliminary Report on Patentability; 19 pgs.

* cited by examiner

SUPPORT CUSHIONS INCLUDING A SUPPORT INSERT WITH A BAG FOR DIRECTING AIR FLOW, AND METHODS FOR CONTROLLING SURFACE TEMPERATURE OF SAME

RELATED APPLICATIONS

This non-provisional application claims priority to and benefit of, under 35 U.S.C. § 119(e), U.S. Provisional Patent Application Ser. No. 62/463,062 titled "Support Cushion Including a Support Insert with a Bag for Direction Air Flow, and Methods for Controlling Surface Temperature of Same" and filed Feb. 24, 2017, all of which is incorporated by reference herein.

TECHNICAL FIELD

The present invention relates to support cushions and methods for controlling the surface temperature of support cushions. In particular, the present invention includes support cushions, such as mattress assemblies, that make use of a support insert with an impermeable or semipermeable membrane to direct air to the surfaces of the support cushions.

BACKGROUND

An aspect of successful and restful sleep is individual sleep comfort. Medical research suggests that sleep deprivation ("sleep debt") can have significant negative impacts on longevity, productivity, and overall mental, emotional, and physical health. Chronic sleep debt has been linked to weight gain and, more specifically, has been observed to not only affect the way the body processes and stores carbohydrates, but has also been observed to alter hormone levels that affect appetite. Moreover, sleep debt may result in irritability, impatience, inability to concentrate, and moodiness, which has led some researchers to suggest a link between sleep debt and worksite accidents, traffic incidents, and general afternoon inattentiveness. Furthermore, sleep disorders have been linked to hypertension, increased stress hormone levels, and irregular heartbeat, and additional research has recently suggested that a lack of sleep can affect immune function, resulting in increased susceptibility to illness and disease, e.g., cancer. In all, researchers have now suggested that sleep debt costs the United States $63 billion annually in lost productivity due to these various effects. Accordingly, a support cushion that improves sleep comfort and lowers individual sleep debt would be both highly desirable and beneficial.

SUMMARY

The present invention includes support cushions and methods for controlling the surface temperature of support cushions. In particular, the present invention includes support cushions, such as mattress assemblies, that make use of a support insert with an impermeable membrane to direct air to the surfaces of the support cushions. Thus, the support cushions of the present invention allow a user to individualize their level of comfort, including sleep comfort, by controlling the amount and/or temperature of the air flowing to the surface of the support cushions.

In one exemplary embodiment of the present invention, a support cushion is provided in the form of a mattress assembly that includes a body supporting layer having a first surface and a second surface opposite the first surface. The mattress assembly further includes a base layer positioned adjacent to the second surface of the body supporting layer and configured to support the body supporting layer. The base layer includes a bottom wall and a side wall positioned on top of the bottom wall. The side wall extends along and around the perimeter of the bottom wall such that the bottom wall and side wall collectively define a cavity. The base layer further includes a support insert positioned within the cavity of the base layer.

In one exemplary embodiment, the support insert includes an array of springs which are substantially surrounded by a bag which defines an inlet hole and an outlet hole opposite the inlet hole and positioned adjacent to and in flow communication with the second surface of the body supporting layer. In another exemplary embodiment, the support insert includes a plurality of foam layers which are substantially surrounded by a bag. In either embodiment, however, the inlet hole of the bag is also aligned with a hole defined through base layer.

The support cushion further includes an air flow unit, which is operably connected to the inlet hole of the bag. The air flow unit includes a fan which provides air flow into the interior of the support insert, and in some embodiments, further includes a heating unit and/or a cooling unit to provide thermally controlled air flow into the interior of the support insert. The bag of the support insert, in some instances, may be made of an impermeable or semipermeable membrane, such as a plastic sheet, or other similar flexible material. In this regard, substantially all of the air flowing into the interior of the support insert is directed out of the outlet hole in the top of the support insert and into and through the overlying body supporting layer. To this end, in some exemplary embodiments, the body supporting layer defines a plurality of channels that extend from the second surface to the first surface and which are substantially aligned with the outlet hole of the support insert. The air flowing out of the outlet hole will therefore be directed into and through the first surface of the body supporting layer via the plurality of channels.

In order to further facilitate air flow through the body supporting layer, in some embodiments, the body supporting layer is comprised of a substantially uniform layer of a porous visco-elastic foam. Such porous foam has characteristics that are, in some embodiments, well suited for use in the body supporting layer of the mattress assembly, including the enhanced ability to permit fluid movement through the porous foam and, consequently, the ability to provide enhanced air movement through the body supporting layer of the mattress assembly. In this regard, air exiting the outlet hole of the bag can then easily be transferred through the body supporting layer to the first surface. In the case where the air flow unit provides heated or cooled air into the support insert, the increased air flow through the body supporting layer will also improve the rate of heating/cooling at the first surface of the body supporting layer.

With respect to the base layer, in some exemplary embodiments, the bottom wall, the side wall, or both the bottom wall and the side wall of the base layer are also comprised of a visco-elastic foam, but other materials are also contemplated including non-viscoelastic foams. In some embodiments, the visco-elastic foam of the base layer is substantially the same as the visco-elastic foam of the body supporting layer. In some other embodiments, the porosity of the foam used in the body supporting layer is greater than the porosity of the bottom wall and/or the side wall of the base layer.

Further features and advantages of the present invention will become evident to those of ordinary skill in the art after a study of the description, figures, and non-limiting examples in this document.

DESCRIPTION OF EXEMPLARY EMBODIMENTS

The present invention includes support cushions and in particular, the present invention includes support cushions, such as mattress assemblies, that make use of a support insert with an impermeable membrane to direct air to the surfaces of the support cushions. Thus, the support cushions of the present invention allow a user to individualize their level of comfort, including sleep comfort, by controlling the amount and/or temperature of the air flowing to the surface of the support cushions.

Figure 1:
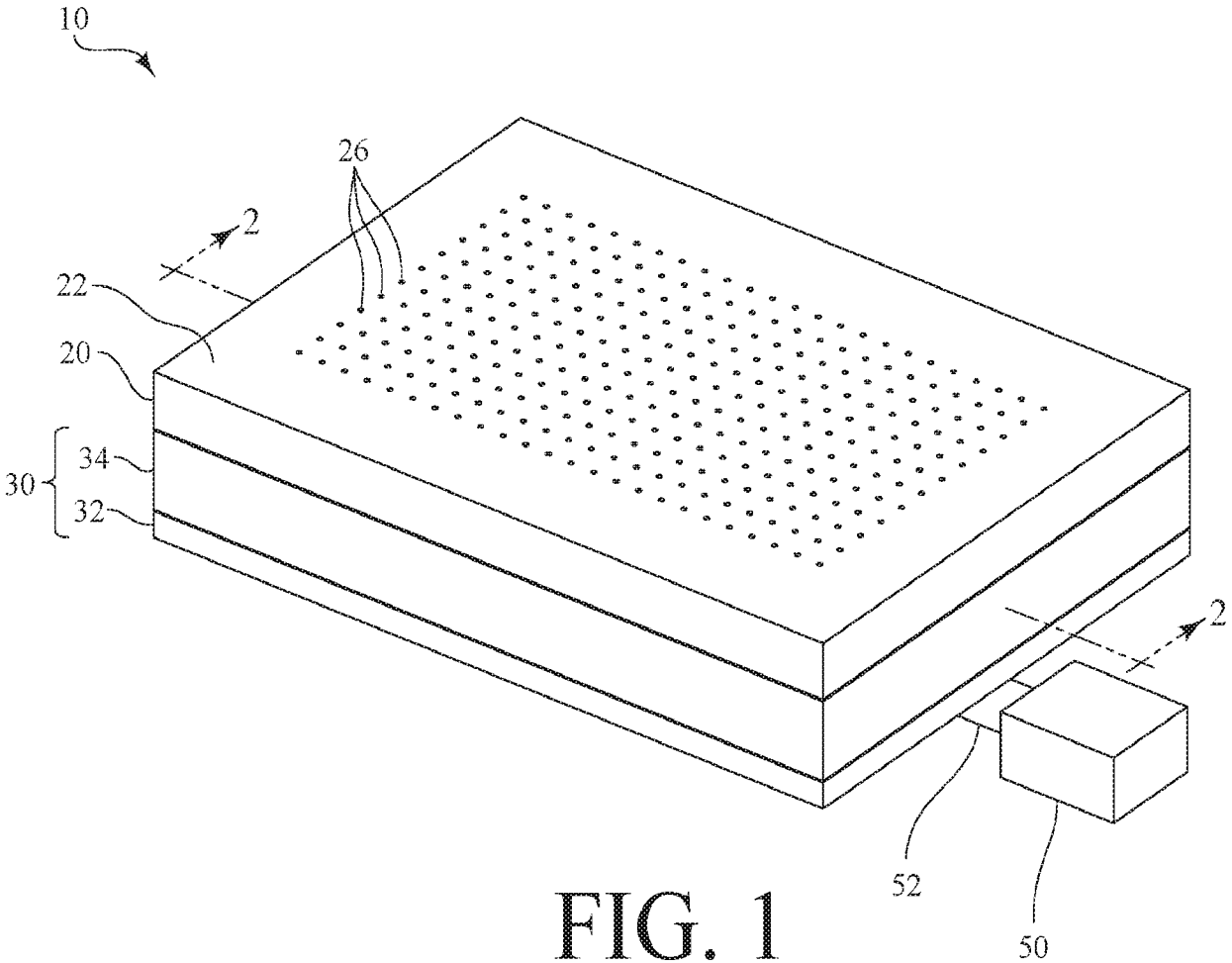
FIG. 1 is a perspective view of an exemplary support cushion, in the form of a mattress assembly, made in accordance with the present invention.
Figure 2:
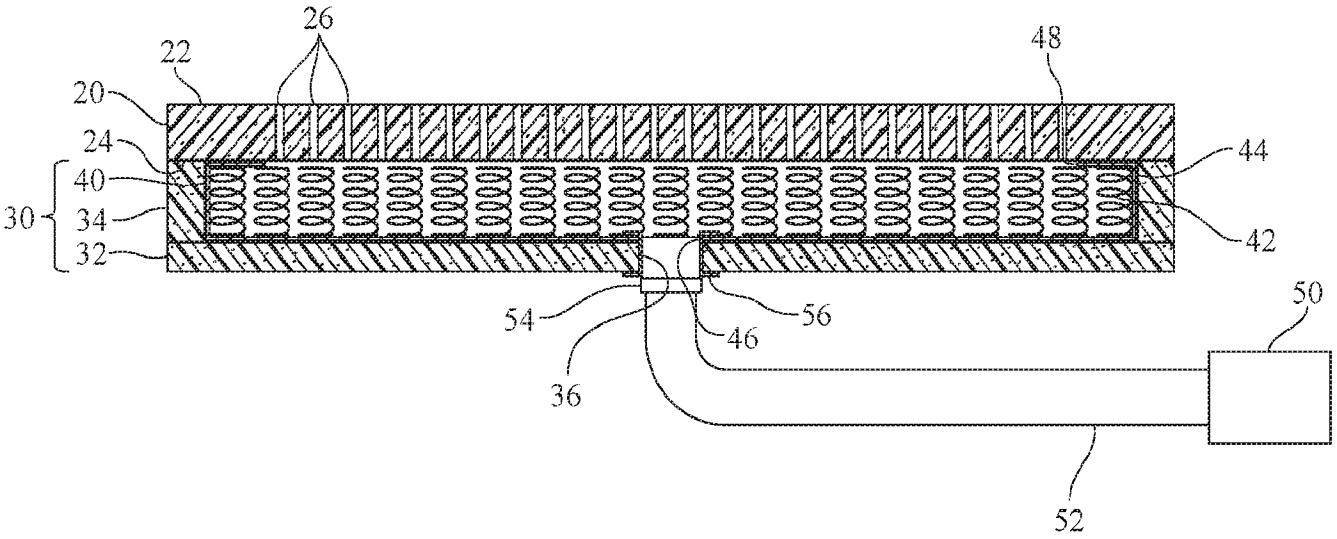
FIG. 2 is a cross-sectional view of the exemplary mattress assembly of FIG. 1 taken along line 2-2 of FIG. 1.
Figure 3:
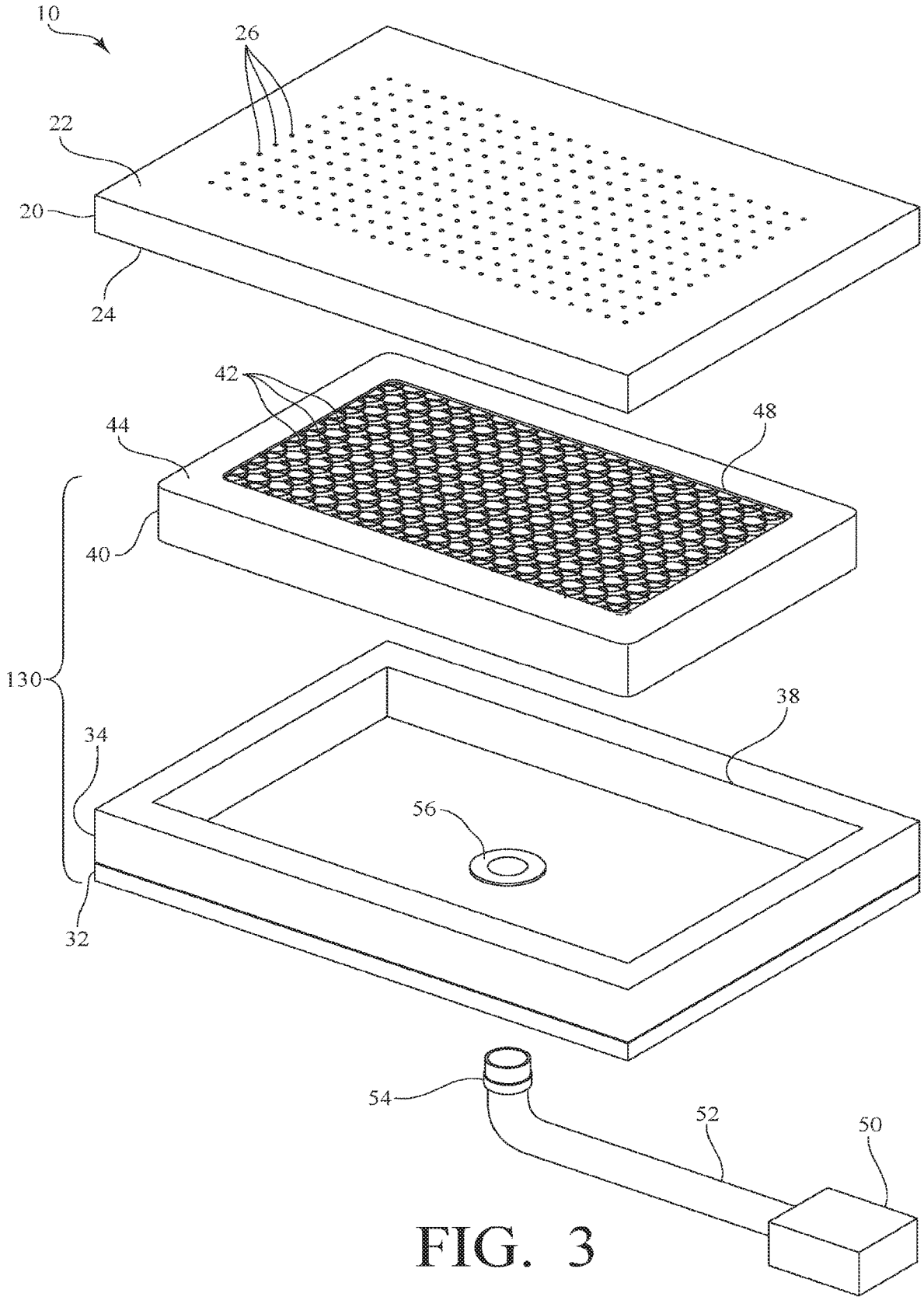
FIG. 3 is an exploded, perspective view of the exemplary mattress assembly of FIG. 1.

Referring first to FIGS. 1-3, in one exemplary embodiment of the present invention, a support cushion in the form of a mattress assembly 10 is provided that includes a body supporting layer 20 having a first surface 22 and a second surface 24 opposite the first surface 22. The mattress assembly 10 further includes a base layer 30 positioned adjacent to the second surface 24 of the body supporting layer 20 and configured to support the body supporting layer 20.

With respect to the base layer 30, and referring now specifically to FIGS. 2 and 3, the base layer 30 includes a bottom wall 32 and a side wall 34 positioned on top of the bottom wall 32 and extending along the perimeter of the bottom wall 32, such that the bottom wall 32 and side wall 34 collectively define a cavity 38. As perhaps best shown in FIG. 3, the bottom wall 32 of the base layer 30 also defines a hole 36, as discussed further below. The base layer 30 further includes a support insert 40 positioned within the cavity 38 of the base layer 30.

Although not specifically illustrated in the Figures, in some embodiments, the base layer may also be a mattress foundation, such as those utilized for use with an adjustable bed.

Referring still to FIGS. 2 and 3, the support insert 40 includes an array of springs 42 which are substantially surrounded by a bag 44. As shown in FIG. 2, the bag 44 defines an inlet hole 46 which is aligned with the hole 36 defined in the bottom wall 32 of the base layer 30. As perhaps best shown in FIG. 3, the bag 44 further defines an outlet hole 48 opposite the inlet hole 46 and positioned adjacent to the second surface 24 of the body supporting layer 20.

Referring still to FIGS. 2 and 3, the mattress assembly 10 further includes an air flow unit, here shown generally as a box 50, which is operably connected to the inlet hole 46 of the bag 44 by way of a conduit 52. In some instances the air flow unit may be embodied by a fan, although it is not so limited. Specifically, as shown in FIG. 2, a flange 56 is operably connected to the inlet hole 46 of the bag 44 with the flange 56 extending through the hole 36 in the bottom wall 32 of the base layer 30. The conduit 52 includes a connector 54 at its distal end which is configured to engage the flange 56 in order to provide a continuous airway between the air flow unit 50 and the interior of the support insert 40.

With respect to the air flow unit 50, although not expressly shown, the air flow unit 50 includes a fan which provides air flow into the interior of the support insert 40 by way of the conduit 52. It is also contemplated that in some embodiments, the air flow unit 50 further includes a heating unit and/or a cooling unit to provide thermally controlled air flow into the interior of the support insert 40.

The bag 44 of the support insert 40 is, in some embodiments, made of an impermeable or semipermeable membrane, which may include, but is not limited to, plastic sheets, fabric materials, or other similar flexible material. In this regard, the term "impermeable membrane" is used herein to generally refer to a material which substantially prevent air from flowing through the material. In this regard, the term "semipermeable membrane" is used herein to generally refer to a materials which prevent at least a portion of air from flowing through the material, which may for example include low permeable materials. Due to the presence of the impermeable or semipermeable membrane 44, the air flowing into the interior of the support insert 40 cannot readily escape through the bottom wall 32 or the side wall 34 of the base layer 30. Therefore, substantially all of the air flowing into the interior of the support insert 40 is directed out of the outlet hole 48 in the top of the support insert 40 and into and through the overlying body supporting layer 20.

To this end, and referring now to FIG. 2 in particular, the body supporting layer 20 defines a plurality of channels 26 that extend from the second surface 24 to the first surface 22 and which are substantially aligned with the outlet hole 48 of the support insert 40. The air flowing out of the outlet hole 48 will therefore be directed to the first surface 22 of the body supporting layer 20 by flowing into and through the plurality of channels 26. Although illustrated in the Figures as a single hole, this is not to be understood as limiting, the outlet hole may include one or more holes.

With respect to the body supporting layer 20, in the exemplary embodiment shown in FIGS. 1-3, the body supporting layer 20 of the mattress assembly 10 is comprised of a continuous layer of flexible foam for suitably distributing pressure from a user's body or portion thereof across the body supporting layer 20. Such flexible foams include, but are not limited to, latex foam, reticulated or non-reticulated visco-elastic foam (sometimes referred to as memory foam or low-resilience foam), reticulated or non-reticulated non-visco-elastic foam, polyurethane high-resilience foam, expanded polymer foams (e.g., expanded ethylene vinyl acetate, polypropylene, polystyrene, or polyethylene), or any combination thereof. In the embodiment shown in FIGS. 1-3, the body supporting layer 20 is comprised of a visco-elastic foam that has a low resilience as well as a sufficient density and hardness, which allows pressure to be absorbed uniformly and distributed evenly across the body supporting layer 20 of the mattress assembly 10. Generally, such visco-elastic foams have a hardness of at least about 10 N to no greater than about 80 N, as measured by exerting pressure from a plate against a sample of the material to a compression of at least 40% of an original thickness of the material at approximately room temperature (i.e., 21° C. to 23° C.), where the 40% compression is held for a set period of time as established by the International Organization of Standardization (ISO) 2439 hardness measuring standard. In some embodiments, the visco-elastic foam has a hardness of about 10 N, about 20 N, about 30 N, about 40 N, about 50 N, about 60 N, about 70 N, or about 80 N to provide a desired degree of comfort and body-conforming qualities.

The visco-elastic foam described herein for use in the mattress assembly 10 can also have a density that assists in providing a desired degree of comfort and body-conforming qualities, as well as an increased degree of material durability. In some embodiments, the density of the visco-elastic foam used in the body supporting layer 20 has a density of no less than about 30 kg/m$^3$ to no greater than about 150 kg/m$^3$. In some embodiments, the density of the visco-elastic foam used in the body supporting layer 20 of the mattress assembly 10 is about 30 kg/m$^3$, about 40 kg/m$^3$, about 50 kg/m$^3$, about 60 kg/m$^3$, about 70 kg/m$^3$, about 80 kg/m$^3$, about 90 kg/m$^3$, about 100 kg/m$^3$, about 110 kg/m$^3$, about 120 kg/m$^3$, about 130 kg/m$^3$, about 140 kg/m$^3$, or about 150 kg/m$^3$. Of course, the selection of a visco-elastic foam having a particular density will affect other characteristics of the foam, including its hardness, the manner in which the foam responds to pressure, and the overall feel of the foam, but it is appreciated that a visco-elastic foam having a desired density and hardness can readily be selected for a particular application or mattress assembly as desired. Additionally, it is appreciated that the body supporting layers of the mattress assemblies need not be comprised of a continuous layer of flexible foam at all, but can also take the form of more traditional mattresses, including spring-based mattresses, without departing from the spirit and scope of the subject matter described herein.

In order to further facilitate air flow through the body supporting layer 20, in some embodiments, the body supporting layer 20 is comprised of a substantially uniform layer of a porous visco-elastic foam. In this regard, the term "porous flexible foam" (visco-elastic or otherwise) is used herein to generally refer to flexible foam having a cellular foam structure in which at least a portion of the cells of the foam are essentially skeletal. In other words, at least a portion of the cells of the foam are each defined by a plurality of apertured windows surrounded by cell struts, where the cell windows of the porous foam can be entirely absent (leaving only the cell struts) or substantially missing. In some embodiments, the foam is considered "porous" if at least 50% of the windows of the cells are missing (i.e., windows having apertures therethrough, or windows that are completely missing and therefore leaving only the cell struts). Such structures can be created by destruction or other removal of cell window material, by chemical or mechanical means, or by preventing the complete formation of cell windows during the manufacturing process of the foam. In some embodiments of the present invention, the term "porous" can thus be used interchangeably with the term "reticulated" when referring to flexible foam.

Regardless of the manufacturing process used to produce the porous foam, porous foam, by virtue of its open cellular structure, has characteristics that are well suited for use in the body supporting layer 20 of the mattress assembly 10, including the enhanced ability to permit fluid movement through the porous foam and, consequently, the ability to provide enhanced air movement through the body supporting layer 20 of the mattress assembly 10. In this regard, air exiting the outlet hole 48 of the bag 44 can then easily be transferred through the body supporting layer 20 to the first surface 22. In the case where the air flow unit 50 provides heated or cooled air into the support insert 40 the increased air flow through the body supporting layer 20 will also improve the rate of heating/cooling at the first surface 22 of the body supporting layer 20.

With respect to the base layer 30, in the exemplary embodiment show in FIGS. 1-3, the bottom wall 32, the side wall 34, or both the bottom wall 32 and the side wall 34 of the base layer 30 are also comprised of a visco-elastic foam, but other materials are also contemplated including non-viscoelastic foams. In some embodiments, the visco-elastic foam of the base layer 30 is substantially the same as the visco-elastic foam of the body supporting layer 20. In some other embodiments, the porosity of the foam used in the body supporting layer 20 is greater than the porosity of the bottom wall 32 and/or the side wall 34 of the base layer 30. With further regard to the side wall 34 in particular, the flexible foam material utilized for the side wall 34 can be chosen to provide a preferred feel and support characteristic. For example, in some embodiments, the side wall 34 can provide substantially the same feel and support as body supporting layer 20, whereas, in some other embodiments, the side wall 34 provides a firmer feel than the body supporting layer 20.

Figure 4:
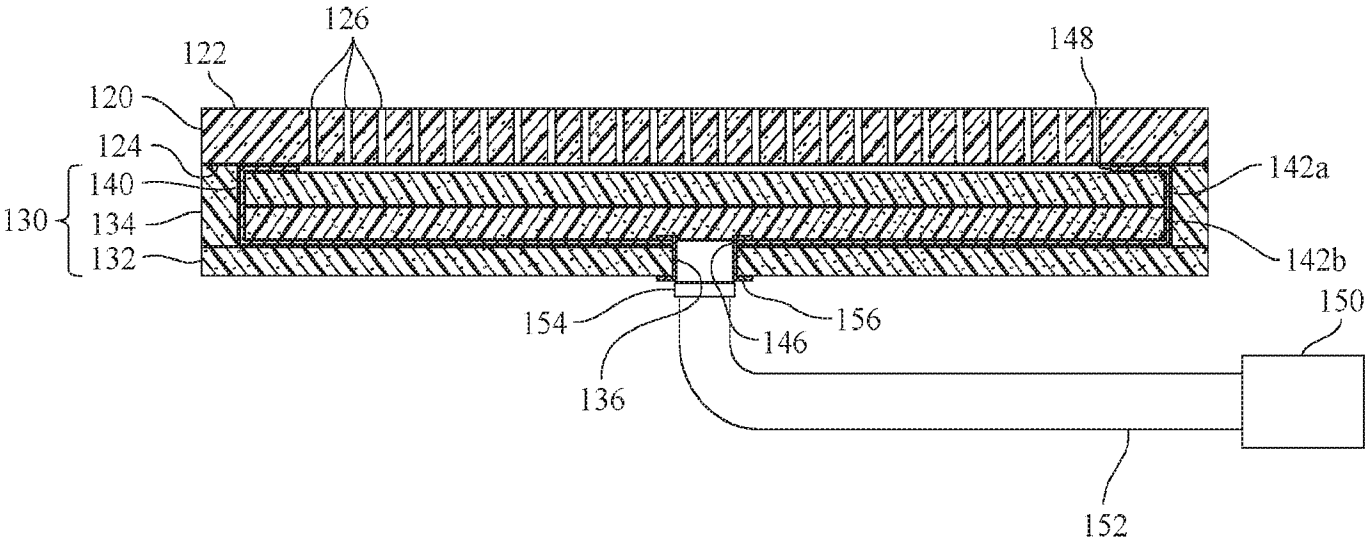
FIG. 4 is a cross-sectional view of another exemplary mattress assembly made in accordance with the present invention.

Furthermore, and referring now to FIG. 4, in another exemplary embodiment of the present invention, the support insert 140 can also include flexible foam. As shown in FIG. 4, a mattress assembly 110 is provided which is substantially the same as the mattress assembly 10 described above with respect to FIGS. 1-3 except that the support insert 140 includes a plurality of foam layers 142*a*, 142*b* instead of an array of springs. In particular, the mattress assembly 110 show in FIG. 4, includes a body supporting layer 120 having a first surface 122 and a second surface 124 that is opposite the first surface 122 and a base layer 130 positioned adjacent to the second surface 124 of the body supporting layer 120. The base layer 130 includes a bottom wall 132 and a side wall 134 that collectively define a cavity 138 with the support insert 140 positioned within the cavity 138 of the base layer 130. The plurality of foam layers 142*a*, 142*b* of the support insert 140 are substantially surrounded by a bag 144, which defines an inlet hole 146 aligned with a hole 136 defined in the bottom wall 132 of the base layer 130 and an outlet hole 148 opposite the inlet hole 146 and positioned adjacent to the second surface 124 of the body supporting layer 120, substantially the same as the bag 44 described above with respect to FIGS. 1-3.

In the embodiment shown in FIG. 4, each of the foam layers 142*a*, 142*b* is comprised of a visco-elastic foam similar to body supporting layer 120, the side wall 134 of the base layer 130, and/or the bottom wall 132 of the base layer 130. With further regard to the support insert 140 shown in FIG. 4, the flexible foam material utilized for the plurality of foam layers 142*a*, 142*b* can be chosen to provide a preferred feel and support characteristic. For example, in some embodiments, the support insert 140 can provide substantially the same feel and support as the side wall 134 of the base layer 130 whereas in some other embodiments, the support insert 140 provides a softer feel than the side wall 134 of the base layer 130. Furthermore, the foam layers 142*a*, 142*b* in the support insert 140 can be configured to provide substantially the same feel and support as the body supporting layer 120. It is additionally contemplated that each of the plurality of foam layers 142*a*, 142*b* can each having various densities and hardnesses.

Regardless of the particular composition of the foam layers 142*a*, 142*b*, the air flow in the embodiment shown in FIG. 4 is substantially the same as described above with respect to the mattress assembly shown in FIGS. 1-3.

Specifically, a fan in the air flow unit 150 pushes air through the conduit 152, into the inlet hole 146 of the bag 144, and out of the outlet hole 148 of the bag 144 where it is then directed through the body supporting layer 120 and out of the first surface 122 of the body supporting layer 120. To this end, in the embodiment shown in FIG. 4, the foam layers 142*a*, 142*b* of the support insert 140 are comprised of a porous visco-elastic foam to allow for greater air flow through the foam layers 142*a*, 142*b*. Furthermore, in some embodiments, the foam layers 142*a*, 142*b* can include structural elements, such as channels that extend through the foam layers 142*a*, 142*b*, to further increase air flow through the foam layers 142*a*, 142*b*.

In order to prevent the various layers of the mattress assemblies 10, 110 from moving relative to one another during use, the bottom wall 32, 132 of the base layer 30, 130 and the side wall 34, 134 of the base layer 30, 130, as well as the body supporting layer 20, 120, are generally secured to one another. Various means of securing one layer of material to another can be used in this regard, including tape, hook and loop fasteners, conventional fasteners, stitches, and the like. In one particular embodiment, the bottom wall 32, 132 of the base layer 30, 130, the side wall 34, 134 of the base layer 30, 130, and the body supporting layer 20, 120 are bonded together by an adhesive or cohesive bonding material to create a substantially continuous assembly. Such adhesive bonding materials include, for example, environmentally-friendly, water based adhesives, like SABA AQUABOND RSD, a two-component water-based adhesive product produced by SABA DINXPERLO BV, B-7090 AA, Dinxperlo, Belgium. In the exemplary embodiments shown in FIGS. 1-4, the side walls 34, 134 are a separate foam layer which is affixed to the bottom walls 32, 132, for example, by an adhesive; however, it is contemplated that, in some instances, the bottom wall and side wall are formed from a single piece of flexible foam, such that the base layer is characterized as having a unitary construction.

In the embodiments shown in FIGS. 1-4, there is one outlet hole 48, 148 which extends across substantially all of the top of the support insert 40, 140, but it is contemplated that in some other embodiments there may be a plurality of smaller outlet holes positioned across the top of the support insert such that air is directed out of the support insert and through the body supporting layer in a predetermined pattern. For example, the amount of air flow through a head portion of the body supporting layer may be different from the amount of air flow through a foot portion of the body supporting layer. In some other embodiments, an additional layer of impermeable material may be positioned between the base layer 30, 130 and the body supporting layer 20, 120 over the outlet hole 48, 148 of the support insert 40, 140 with this additional layer defining one or more holes to similarly result in air directed out of the support insert 40, 140 and through the body supporting layer 20, 120 in a predetermined pattern.

In the embodiments shown in FIGS. 1-4, the inlet hole 46, 146 of the support insert 40, 140 is aligned with the hole 36 in the bottom wall 32, 132 of the base layer 30, 130, but it is further contemplated that the inlet can be located on the side of the support insert with a corresponding hole defined through the side wall of the base layer. Furthermore, although in the embodiments shown in FIGS. 1-4, the air flow unit 50, 150 is connected by the conduit 52, 152 such that the air flow unit 50, 150 is positioned a distance away from the rest of the mattress assembly 10, 110, other positions are contemplated including mounting the air flow unit 50, 150 to the base layer 30, 130 and/or within the confines of the support cushion assembly 10, 110.

As a refinement, and although not shown in the figures, additional components or layers can also be included with the mattress assembly of the present invention. For example, in some embodiments, the body supporting layers of the mattress assemblies are further covered by a comfort portion or layer that is positioned atop the body supporting layer and provides a level of comfort to a body of a user or a portion of thereof that is resting on the mattress assembly. The comfort layer can also be comprised of a visco-elastic foam. However, the comfort layer typically has a density, hardness, or both that is less than that of the body supporting layer of the mattress assembly, such that the comfort layer provides a softer surface on which to rest the body of a user or a portion thereof.

As a further refinement, the mattress assembly can further include a controller for controlling the air flow unit which provides the air flow to the first surface of the body supporting layer. By including a controller in the mattress assembly, not only can the amount of air flow be controlled, but the temperature of the air flow can also be controlled to provide a desired amount of heating or cooling at the first surface of the body supporting layer of the mattress assembly.

As an additional refinement, to ensure that fresh air is entering the base layer, the mattress assembly can further include a filter, such that only filtered air is allowed to pass into the inlet hole and the bag is kept free of particulates such as smoke, dust, dirt, pollen, mold, bacteria, hair, or insects that may otherwise collect in the interior of the mattress and limit air flow. Of course, it is contemplated that various types of filters including, but not limited to, charcoal filters for removing chemicals and/or unpleasant odors can be readily incorporated into an exemplary mattress of the present invention without departing from the spirit and scope of the subject matter described herein. In some embodiments, it is further contemplated that air freshener or perfume may further be added to the assemblies (e.g., before the fan) such that scented air is directed to the surface of the support cushion assemblies.

Each of the exemplary support cushions described herein can also be used as part of a method of controlling a surface temperature of a support cushion. In some implementations, a method of controlling the surface temperature of a support cushion includes first providing a support cushion of the present invention. Electrical current is then supplied to the air flow unit such that the fan of the air flow unit pushes an amount of air into the inlet hole of the support insert, and moves air out of the outlet hole of the support insert, through the body supporting layer and out of the first surface of the body supporting layer. For implementations where air flow unit includes a heating unit and/or a cooling unit, electrical current can also be supplied to the heating/cooling unit such that the temperature of the air flowing out of the first surface of the body supporting layer is adjusted.

One of ordinary skill in the art will recognize that additional embodiments are also possible without departing from the teachings of the present invention or the scope of the claims which follow. This detailed description, and particularly the specific details of the exemplary embodiments disclosed herein, is given primarily for clarity of understanding, and no unnecessary limitations are to be understood therefrom, for modifications will become apparent to those skilled in the art upon reading this disclosure and may be made without departing from the spirit or scope of the claimed invention.

What is claimed is:

1. A support cushion, comprising:

a body supporting layer formed of a first foam having a first surface and a second surface opposite the first surface, the body supporting layer having a plurality of airflow channels extending between the first surface and the second surface that deliver comfort air to the body supporting layer;

a base layer formed of a second foam different from said first foam positioned adjacent to and bonded to the second surface of the body supporting layer, the base layer defining a cavity with a support insert positioned within the cavity, the support insert including a bag defining an inlet hole and one or more outlet holes positioned adjacent to and in flow communication with the second surface of the body supporting layer;

an array of springs surrounded by the bag, or one or more layers of foam surrounded by the bag, wherein ambient air flow disperses through the bag and the one or more layers of foam or the array of springs before exiting through the one or more outlet holes of the bag and into the body supporting layer;

a fan operably connected to the inlet hole of the bag by a conduit wherein the conduit extends into the support cushion to the bag and wherein the conduit provides the ambient air flow directly into the inlet hole of the bag and out of the one or more outlet holes of the bag, wherein the ambient air flow spreads within the support cushion, and wherein the ambient air flow is solely said comfort air that exits only through said plurality of airflow channels.

2. The support cushion of claim 1, the array of springs configured to support the body supporting layer.

3. The support cushion of claim 1, wherein the support insert further comprises one or more foam layers substantially surrounded by the bag, the one or more foam layers configured to support the body supporting layer.

4. The support cushion of claim 1, wherein the body supporting layer defines the plurality of airflow channels extending from the second surface to the first surface, the plurality of airflow channels substantially aligned with the one or more outlet holes of the bag.

5. The support cushion of claim 1, wherein the base layer includes a bottom wall and a side wall positioned on top of the bottom wall, the side wall extending along a perimeter of the bottom wall.

6. The support cushion of claim 5, wherein the bottom wall of the base layer defines a hole aligned with the inlet hole of the bag.

7. The support cushion of claim 1, wherein the bag is comprised of an impermeable material.

8. The support cushion of claim 7, wherein the bag is comprised of a plastic sheet.

9. The support cushion of claim 1, wherein the body supporting layer, the base layer, or both the body supporting layer and the base layer are comprised of a visco-elastic foam.

10. The support cushion of claim 9, wherein the body supporting layer is comprised of a porous visco-elastic foam.

11. The support cushion of claim 9, wherein the visco-elastic foam comprising the body supporting layer has a porosity greater than that of the visco-elastic foam comprising the base layer.

12. The support cushion of claim 1, further comprising a heating unit, a cooling unit, or both a heating unit and a cooling unit configured to provide thermally controlled air flow into the inlet hole of the bag and out of the one or more outlet holes of the bag.

13. The support cushion of claim 1, wherein the fan is operably connected to the inlet hole of the bag by a conduit positioned a distance away from the support cushion.

14. The support cushion of claim 1, wherein the fan is mounted to the base layer.

15. A mattress assembly, comprising:

a body supporting layer comprised of visco-elastic foam and having a first surface and a second surface opposite the first surface, the body supporting layer defining a plurality of channels extending from the second surface to the first surface;

a base layer positioned adjacent to and bonded to the second surface of the body supporting layer, the base layer defining a cavity with a support insert positioned within the cavity, the support insert including an impermeable material defining an inlet hole and one or more outlet holes, the one or more outlet holes positioned adjacent to and in flow communication with the second surface of the body supporting layer and aligned with the plurality of channels extending through the body supporting layer; and an array of springs surrounded by the impermeable material, or one or more layers of foam surrounded by the impermeable material, wherein ambient air flow disperses through the impermeable material and the one or more layers of foam or the array of springs before exiting through the one or more outlet holes of the impermeable material and into the body supporting layer;

a fan operably connected to the inlet hole of the impermeable material by a conduit that extends into the base layer and is directly connected to the impermeable material to provide ambient air flow into the inlet hole of the impermeable material and out of the one or more outlet holes of the impermeable material, wherein the ambient air flow exits only through said plurality of channels and the ambient air flow is solely comfort air to comfort a user.

16. The mattress assembly of claim 15, wherein the support insert further comprises an array of springs substantially surrounded by the impermeable material, the array of springs configured to support the body supporting layer.

17. The mattress assembly of claim 15, wherein the support insert further comprises one or more foam layers substantially surrounded by the impermeable material, the one or more foam layers configured to support the body supporting layer.

18. The mattress assembly of claim 15, wherein the fan is operably connected to the inlet hole of the impermeable material by a conduit positioned a distance away from the mattress assembly.

19. The mattress assembly of claim 15, wherein the fan is mounted to the base layer.

20. A method of controlling air flow through a support cushion, comprising the steps of:

providing a support cushion having a body supporting layer formed of a first foam having a first surface and a second surface opposite the first surface, a base layer formed of a second foam different from said first foam positioned adjacent to the second surface of the body supporting layer, the base layer defining a cavity with a support insert positioned within the cavity, the support insert including a bag defining one or more outlet holes positioned adjacent to and in flow communication with the second surface of the body supporting layer and an inlet hole, and a fan operably connected to a conduit that extends into the base layer, the conduit being directly connected to the inlet hole of the bag to provide ambient air flow into the inlet hole of the bag and out of the one or more outlet holes of the bag;

supplying an electrical current to the fan such that the fan pushes an amount of ambient air into the inlet hole of the bag; and moving the amount of ambient air out of the one or more outlet holes of the bag, through the body supporting layer and solely out of the first surface of the body supporting layer as a comfort air which comforts a user.

* * * * *